US008950893B2

(12) United States Patent
Mitchell et al.

(10) Patent No.: US 8,950,893 B2
(45) Date of Patent: Feb. 10, 2015

(54) LED LIGHT

(71) Applicant: Kason Industries, Inc., Newnan, GA (US)

(72) Inventors: Brett A Mitchell, Newnan, GA (US); Raymond J Hiller, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 180 days.

(21) Appl. No.: 13/761,010

(22) Filed: Feb. 6, 2013

(65) Prior Publication Data

US 2014/0218910 A1 Aug. 7, 2014

(51) Int. Cl.

| | |
|---|---|
| ***F21V 1/00*** | (2006.01) |
| ***F21V 29/00*** | (2006.01) |
| ***F21V 15/01*** | (2006.01) |
| ***F21V 15/06*** | (2006.01) |
| ***F21V 23/00*** | (2006.01) |
| ***F25D 27/00*** | (2006.01) |
| *F21Y 101/00* | (2006.01) |

(52) U.S. Cl.

CPC ..... *F21V 29/002* (2013.01); *F21V 15/011* (2013.01); *F21V 15/06* (2013.01); *F21V 23/009* (2013.01); *F25D 27/00* (2013.01); *F21Y 2101/00* (2013.01)

USPC ..... 362/235; 362/545; 362/547; 362/249.02

(58) Field of Classification Search

CPC ..... F21Y 2101/02; F21V 29/004; F21K 9/00

USPC ..... 362/235, 545, 547, 249.02, 373

See application file for complete search history.

(56) References Cited

U.S. PATENT DOCUMENTS

| | | | |
|---|---|---|---|
| 6,179,447 | B1 | 1/2001 | Ishikawa et al. |
| 6,361,192 | B1 | 3/2002 | Fussell et al. |
| 6,371,637 | B1 | 4/2002 | Atchinson et al. |
| 6,439,743 | B1 | 8/2002 | Hutchison |
| 6,481,873 | B1 | 11/2002 | Smith |
| 6,739,734 | B1 | 5/2004 | Hulgan |
| 6,853,151 | B2 | 2/2005 | Leong et al. |
| 6,860,628 | B2 | 3/2005 | Robertson et al. |
| 7,049,761 | B2 | 5/2006 | Timmermans et al. |
| 7,114,830 | B2 | 10/2006 | Robertson et al. |
| 7,249,865 | B2 | 7/2007 | Robertson |
| D569,543 | S | 5/2008 | Toda |
| 7,487,781 | B2 | 2/2009 | Horiuchi et al. |

(Continued)

FOREIGN PATENT DOCUMENTS

| | | |
|---|---|---|
| AU | 723764 | 9/2000 |

*Primary Examiner* — Vip Patel

(74) *Attorney, Agent, or Firm* — Baker Donelson; Dorian B. Kennedy

(57) ABSTRACT

There is disclosed a LED light (10) including a lower housing (14), an upper housing (15), and a thermally insulative base gasket (16). The upper housing has a top wall (31) with a central mounting area (35) and a peripheral margin. The wall thickness of the central mounting area is thicker than that of the peripheral margin (38). The upper housing also includes a plurality of heat dissipating ribs (41) extending between the mounting area and the sidewalls. The ribs increase in height as they extend outwardly toward the sidewalls. The lighting portion includes a LED light array (37), a lens (48), and a lens gasket (49). With the LED array mounted to the central mounting area, heat generated by the LED array is conveyed to the central mounting area and then conveyed through the upper housing top wall and ribs to the sidewalls.

14 Claims, 3 Drawing Sheets

(56) References Cited

U.S. PATENT DOCUMENTS

| | | | |
|---|---|---|---|
| 7,488,086 | B2 | 2/2009 | Wu et al. |
| 7,507,001 | B2 | 3/2009 | Kit |
| 7,510,299 | B2 | 3/2009 | Timmermans et al. |
| 7,549,781 | B2 | 6/2009 | Kim et al. |
| 7,688,526 | B2 | 3/2010 | Lu et al. |
| 7,758,227 | B1 | 7/2010 | Coleman |
| D631,567 | S | 1/2011 | Lodhie |
| 7,862,204 | B2 | 1/2011 | Lodhie |
| 2003/0102810 | A1 | 6/2003 | Cross et al. |
| 2004/0012959 | A1 | 1/2004 | Robertson et al. |
| 2007/0070621 | A1 | 3/2007 | Rivas et al. |
| 2009/0109674 | A1 | 4/2009 | Lodhie |

LED LIGHT

TECHNICAL FIELD

This invention relates generally to a light, and more particularly to an LED light.

BACKGROUND OF INVENTION

Light fixtures with light bulbs mounted thereto have existed for many years. Oftentimes, light fixtures are utilized in cold environments such as walk in refrigerators and freezers to provide light. However, today's governmental regulations requires that lighting used in commercial refrigeration meets stringent lumen per watt efficiency standards. The standards virtually eliminate previously used incandescent light bulbs under normal conditions because they are inefficient generators of light and they create a large amount of heat in the refrigerated space.

As such, refrigerated spaces are now provided with enclosed and gasket water proof incandescent fixtures with a translucent cover, oftentimes referred to as "jelly jar" covers. A compact florescent bulb (CFL) is currently utilized with these fixtures. However, these CFL bulbs suffer from problems relating to their placement within cold environments such as refrigerated spaces. For example, these refrigerated CFL bulbs take several minutes to warm up enough to produce light. Also, a refrigerated CFL bulb is very inefficient and at −20 degrees Fahrenheit may make less than 10% output when energized. Another problem associated with CFL bulbs in refrigerated spaces stems from the fact that the light fixtures are typically positioned over the door leading into the refrigerated space. This positioning of the light fixtures means that the bulb must project light outwardly from its end to illuminate the far end of the refrigerated space. A CFL bulb however does not project light very well in this direction due to the configuration of the CFL bulb and therefor the far end of the refrigerated space distal the door may not be properly illuminated. Lastly, CFL bulbs include mercury which may be harmful to the environment when improperly disposed.

In an effort to overcome the problems associated with incandescent and CFL lights designers are now utilizing LED lights in cold room environments. However, a problem with LED lights is that they are typically enclosed within a housing to protect them from the cold room environment. The enclosing of the LED lights leads to another problem which is that the LED lights do not have an efficient way of dissipating heat which causes damage to the LEDs. As such, during the construction of the cold space or during times when the cold space is not cooled, the use of the LED lights leads to an overheating of the light and damage to the LED lights.

Accordingly, it is seen that a need remains for an LED light fixture which may be placed in a refrigerated space without overheating. It is to the provision of such therefore that the present invention is primarily directed.

SUMMARY OF THE INVENTION

In a preferred form of the invention a LED light for a cold room environment comprises a housing having at least a thermally conductive top wall and peripheral sidewalls. The top wall has a top surface, a bottom surface, a central region with a first wall thickness between the top surface and the bottom surface, and a peripheral margin extending between the central region and the peripheral sidewalls with a second wall thickness between the top surface and the bottom surface smaller than the central region first wall thickness. The LED light also includes a plurality of LED light elements mounted in thermal contact with the top surface of the top wall in the central region, a lens coupled to the housing covers the plurality of LED light elements, and a power supply circuit positioned within the housing and electrically coupled to the LED light elements. With this construction, the housing central region is a heat sink which conducts heat away from the plurality of LED light elements.

DETAILED DESCRIPTION

Figure 1:
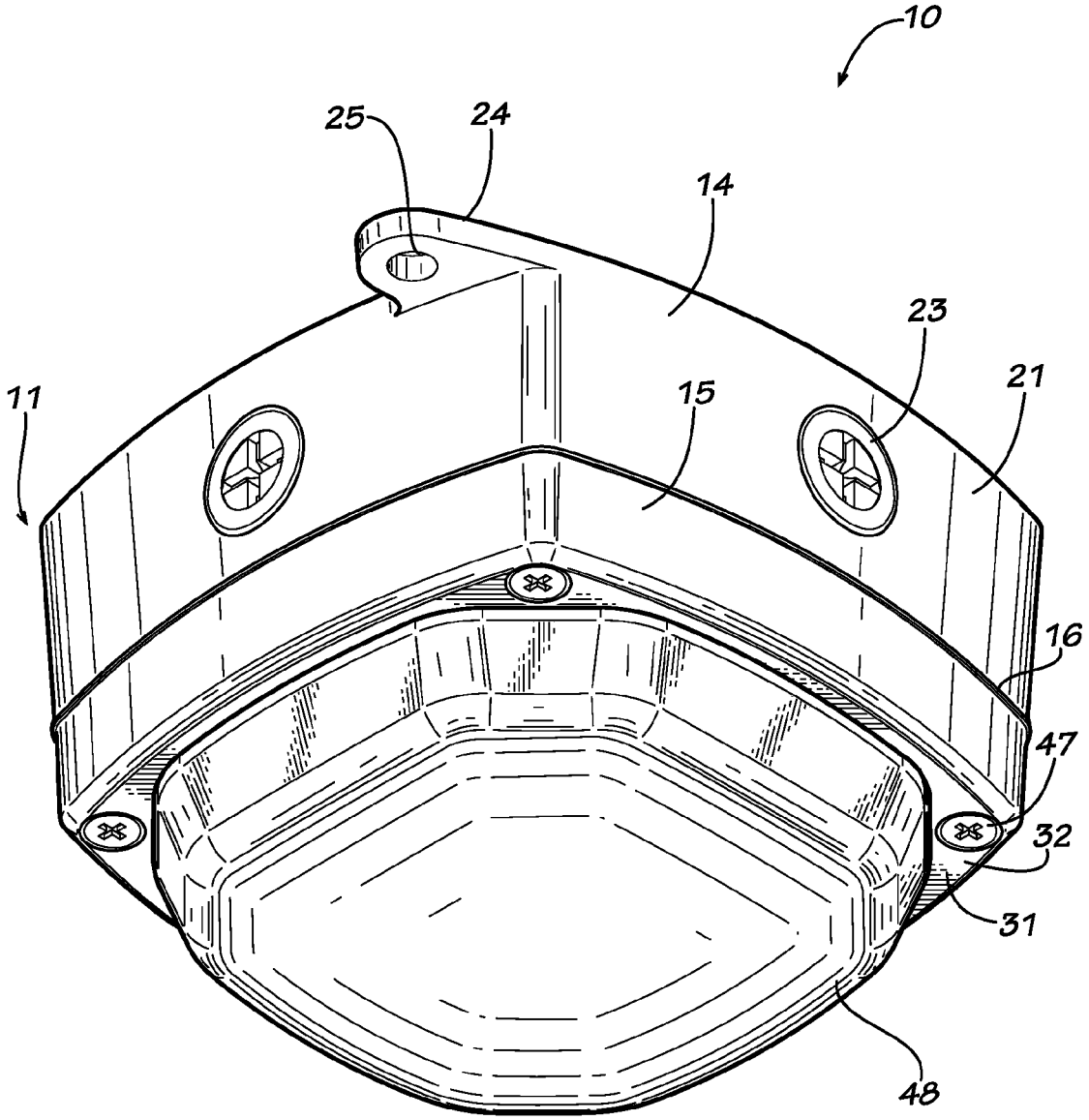
FIG. 1 is a perspective view of a LED light embodying principles of the invention in a preferred form.
Figure 2:
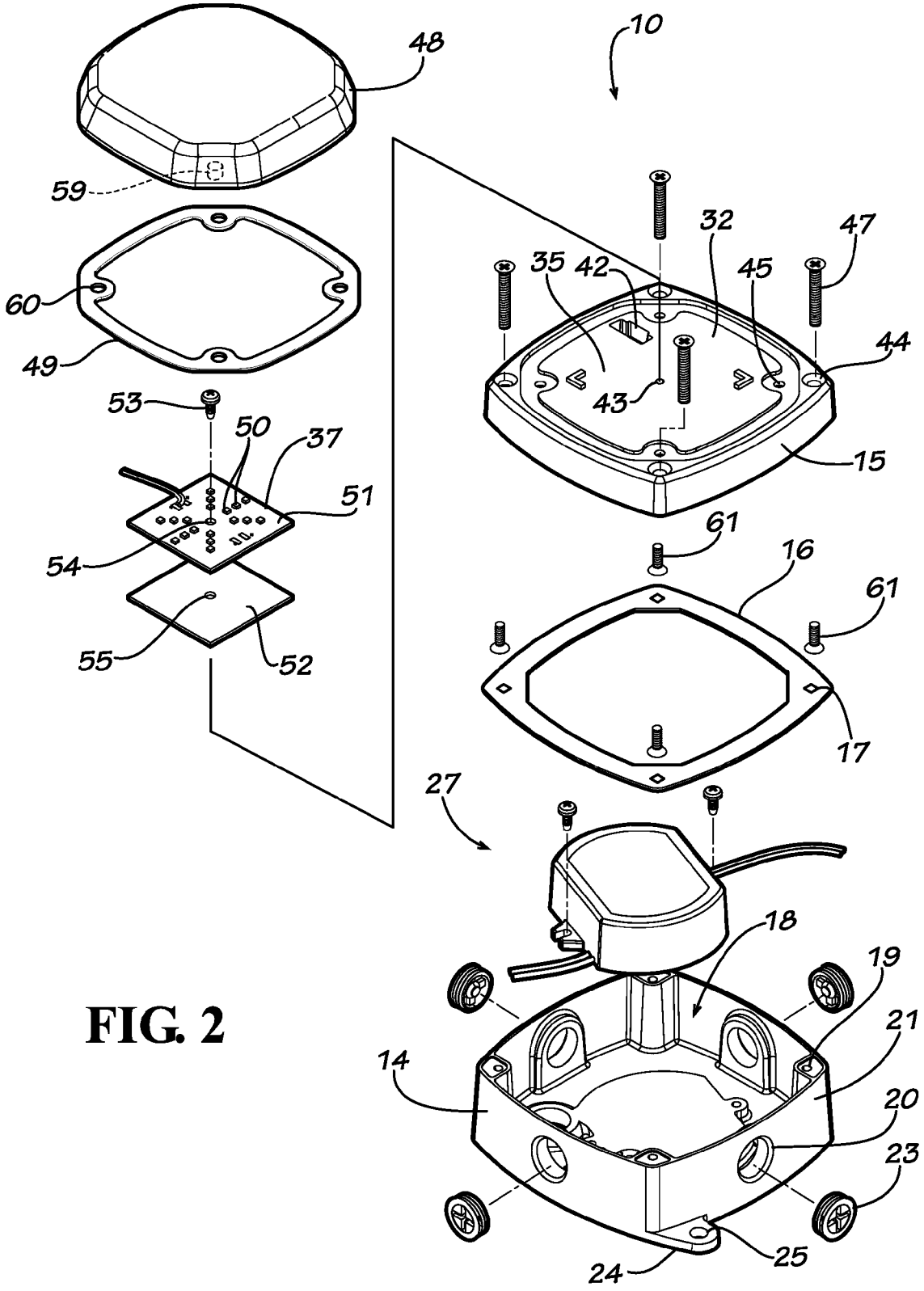
FIG. 2 is an exploded perspective view of the LED light of FIG. 1.
Figure 3:
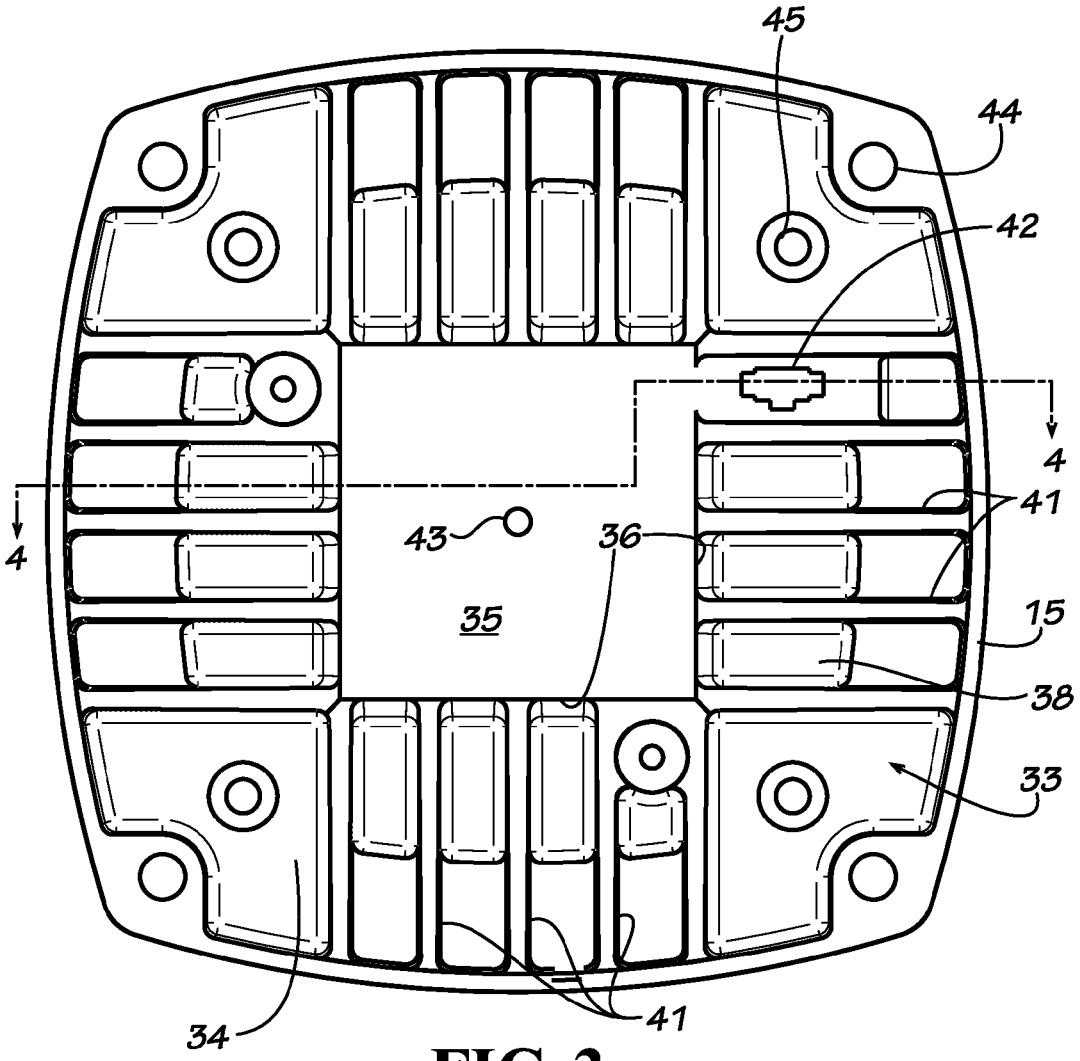
FIG. 3 is a bottom view of the upper housing of the LED light of FIG. 1.
Figure 4:
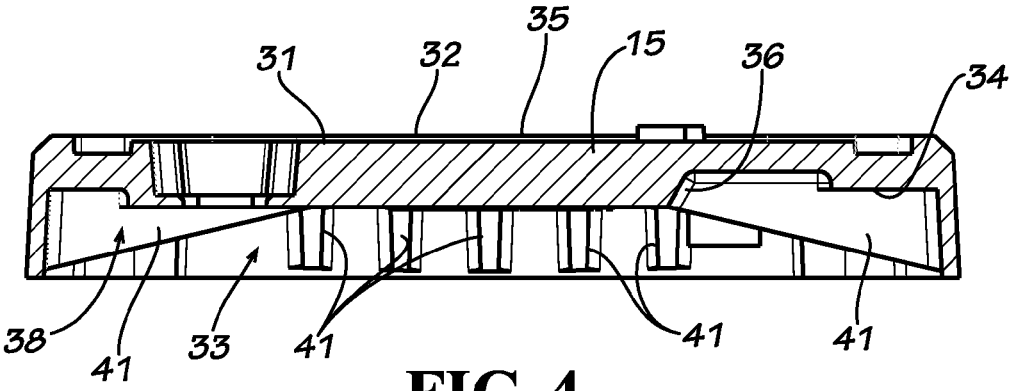
FIG. 4 is a cross-sectional view of the upper housing of the LED light of FIG. 1.

With reference next to the drawings, there is shown a LED light 10 according to the present invention. The light 10 has a main housing portion or housing 11 and a lighting portion 12.

The housing 11 includes a base, junction box or main lower housing 14, a corresponding main upper housing 15, and abase gasket 16 positioned between the lower housing 14 and upper housing 15. The thermally insulative base gasket 16 is positioned between the upper housing 15 and the lower housing 14. The base gasket 16 has four mounting holes 17 and is preferably made of a thermally insulative vulcanized fiber material. The upper and lower housings are preferably made of a thermally conductive material such as an aluminum alloy.

The lower housing 14 includes a large well, cavity or recess 18, four internally threaded housing mounting holes 19, and four conduit openings 20 extending through each of the four sidewalls 21 which define the recess 18. Each conduit opening 20 has a threaded plug 23 therein which seals the opening. A pair of oppositely disposed mounting flanges or ears 24 extend outwardly from the sidewalls 21, each of which includes a wall mounting hole 25 therethrough. A mounting bolt or screw may be passed through the wall mounting hole 25 and into the underlying structure to mount the light 10 to the underlying structure, such as the refrigerator interior wall.

A power supply circuit or power supply 27 which includes a power transformer and the conventional electronics required to operate LED type lights, is mounted within the recess 18 and has electrical wires extending to the exterior through one of the conduit openings plugs 23 adapted to receive electrical wires therethrough. The power source preferably provides an input voltage of 85-305 VAC with an input current of <0.4 A (at 115V), and an output voltage of 18-40 VDC with an output current of 350 MA at a frequency of 47-63 Hz.

The upper housing 15 has a top wall 31 with a top surface 32 and a well, cavity or recess 33 extending from a bottom side so as to define a recessed bottom surface 34 opposite the top surface 32. The bottom surface 34 is raised in a central region to define a generally square, central mounting area 35 defined by four boundary walls 36, which generally corresponds to the area below which an LED array 37 is mounted as described in more detail hereinafter. The wall thickness of the central mounting area 35 is thicker than the wall thickness of the peripheral margin 38 surrounding the central region 35. The term thickness as used herein is the size of the wall between the exterior top surface 32 and the interior bottom surface 34. The upper housing 15 also includes a plurality of heat dissipating heat pipes, bridges, stanchions, or ribs 41 within the peripheral margin 38, shown as five ribs, extending between each boundary wall 36 of the mounting area 35 and the sidewalls 21. The ribs 41 increase in height, and therefore overall mass, as the ribs 41 extend outwardly toward the sidewalls 21. The upper housing 15 also has an electronic coupler passageway 42, a central LED array mounting hole 43, four housing mounting holes 44, and four lens mounting holes 45. Threaded housing mounting screws 47 extend through the housing mounting holes 47 of the upper housing 15, through the base gasket mounting holes 17, and threadably into the housing mounting holes 44 of the lower housing 14 to seal the upper housing 15 to the lower housing 14.

The lighting portion 12 includes the LED light array 37, a lens 48, and a lens gasket 49. The LED light array 37 includes a plurality of LED light elements or diodes 50 mounted to a conventional LED board 51. The LED light array 37 is coupled to an underlying LED pad 52 and mounted to the top surface 32 of the upper housing 15 at the location of the central mounting area 35. The LED light array 37 is mounted to the upper housing 15 with a mounting screw 53 extending through an array mounting hole 54 in the LED light array board 51 and a pad mounting hole 55 in the LED pad. The LED light diodes 50 are preferably arranged in a radially extending pattern of three LED diodes 50 per radial line. The number and arrangement of LED light diodes 50 may vary according to the amount of produced light and distribution of produced light that is desired. The pattern shown herein produces a light output of greater than 1300 lm with a minimum luminaire efficacy of 80 lm/W, and a minimum CRI: Ra>80. The LED array 37 is electrically coupled to the power supply 27 through an electrical coupler extending through the upper housing electronic coupler passageway 42. The LED pad 52 is made of a thermally conductive material, preferably a silicon/rubber type material such as that sold under the tradename Sil-Pad 900S made by Bergquist Company of Chanhassen, Minn. The LED pad 52 aids in transferring heat from the LED lights to the central mounting area 35 of the upper housing.

The lens 48 is generally a transparent or translucent cover and may be made of a shatter resistant plastic material, such as polycarbonate material. The lens 48 is a low profile lens to throw just enough light to the sides for distribution in a room without exceeding the limits of energy efficient guidelines for the surface mounted luminaire category, for example, which requires 75% of the light in the angle of 1 to 60 degrees from nadir. The lens 48 has four internally threaded lens mounting holes 59 therein. The lens gasket 49 has an open central region and four mounting holes 60 generally aligned with upper housing lens mounting holes 45. A lens mounting screw 61 is passed up through each upper housing lens mounting hole 45, through each lens gasket mounting hole 60, and threaded into each lens mounting hole 59 of the lens 48 to sealably couple the lens 48 to the top surface 32 of the upper housing 15.

In use, the lens mounting screws 61 that hold the lens 48 to the upper housing 15 are not accessible from the exterior of the light 10. To access the LED array 37 one must remove the lens 48 from the upper housing 15. To do so, the housing mounting screws 47 must first be unthreaded from the lower housing mounting holes 19, thereby allowing the upper housing 15 to be separated from the lower housing 14. The lens mounting screws 61 are then accessible wherein they may be unthreaded from the lens mounting holes 59 to allow the lens 48 to be separated from the upper housing 15. Only now is the LED array 37 accessible to a person. Mounting the lens mounting screws 61 in an exteriorly inaccessible position prevents people from easily removing the lens and thereby prevents them from touching and thereby damaging the LED array 37.

With the LED array 37 mounted to the central mounting area 35 of the upper housing 15, heat generated by the LED array 37 is transferred or conveyed to the central mounting area 35, which acts as a heat sink. The heat conveyed to the central mounting area 35 is then conveyed through the upper housing top wall 31 to the peripheral sidewalls 21. The ribs 41 also aid in conveying the heat from the central mounting area 35 to the sidewalls 21. It is believed that the increasing height of the ribs 41 aids in conveying the heat towards the sidewalls in a faster manner as the mass is increased as the ribs extend outwardly towards the sidewalls. It should be noted that the present light is designed to be mounted within a cold room environment. As such, the exterior walls, including sidewalls 21, are directly exposed to the cold environment of the cold room and thus allows the heat to be quickly and efficiently dissipated. However, during times when the environment is not cooled, the heat sink and ribs still dissipate heat in a manner to prevent the overheating of the LED lights.

It thus is seen that a cold room light is now provided which overcomes problems associated with the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A LED light for a cold room environment comprising, a housing having at least a thermally conductive top wall and peripheral sidewalls, said top wall having a top surface, a bottom surface, a central region with a first wall thickness between said top surface and said bottom surface, and a peripheral margin extending between said central region and said peripheral sidewalls with a second wall thickness between said top surface and said bottom surface smaller than said central region first wall thickness;

a plurality of LED light elements mounted in thermal contact with said top surface of said top wall in said central region;

a lens coupled to said housing and covering said plurality of LED light elements, and a power supply circuit positioned within said housing and electrically coupled to said LED light elements, whereby the housing central region is a heat sink which conducts heat away from the plurality of LED light elements.

2. The LED light of claim 1 further comprising a thermally conductive LED pad mounted between said plurality of LED light elements and said housing top wall to aid in conducting heat from said LED light elements to said housing top wall.

3. The LED light of claim 1 further comprising a plurality of heat conducting ribs extending between said central region and said sidewalls.

4. The LED light of claim 1 wherein said housing includes a top portion having said top wall and a bottom portion, and wherein said LED light further comprises a thermally resistive gasket between said top portion and said bottom, and wherein said power supply is positioned within said bottom portion.

5. The LED light of claim 3 wherein said central portion has a plurality of boundary walls and wherein a plurality of heat conducting ribs extend between each boundary wall and an adjacent sidewall.

6. A LED light comprising, a housing having a thermally conductive top wall and sidewalls extending from said top wall, said top wall having a central region and a peripheral margin at least partially about said central region, said central region having a wall thickness greater than the wall thickness of said peripheral margin;

a plurality of LED light elements mounted in thermal contact with said top wall central region;

a lens mounted over said plurality of LED light elements, and a power supply circuit electrically coupled to said LED light elements, whereby the housing central region is a heat sink which conducts heat away from the plurality of LED light elements.

7. The LED light of claim 6 further comprising a thermally conductive LED pad mounted between said plurality of LED light elements and said housing top wall to aid in conducting heat from said LED light elements to said housing top wall.

8. The LED light of claim 6 further comprising a plurality of heat conducting ribs extending between said central region and said sidewalls.

9. The LED light of claim 6 wherein said housing includes a top portion having said top wall and a bottom portion, and wherein said LED light further comprises a thermally resistive gasket between said top portion and said bottom, and wherein said power supply is positioned within said bottom portion.

10. The LED light of claim 8 wherein said central portion has a plurality of boundary walls and wherein a plurality of heat conducting ribs extend between each boundary wall and an adjacent sidewall.

11. A LED light comprising, a housing having a thermally conductive top wall and sidewalls extending from said top wall, said top wall having an LED heat sink region distally from said sidewalls and a plurality of heat transferring ribs extending between said LED array heat sing region and said sidewalls;

a plurality of LED light elements mounted in thermal contact with said LED heat sink region;

a lens mounted over said plurality of LED light elements, and a power supply circuit electrically coupled to said LED light elements, whereby the LED heat sink region absorbs heat from the LED light elements and the heat is then transferred to the sidewalls through the heat transferring ribs.

12. The LED light of claim 11 further comprising a thermally conductive LED pad mounted between said plurality of LED light elements and said LED heat sink region to aid in conducting heat from said LED light elements to said LED heat sink region.

13. The LED light of claim 11 wherein said housing includes a top portion having said top wall and a bottom portion, and wherein said LED light further comprises a thermally resistive gasket between said top portion and said bottom, and wherein said power supply is positioned within said bottom portion.

14. The LED light of claim 11 wherein said LED heat sink region has a plurality of boundary walls and wherein a plurality of heat transferring ribs extend between each boundary wall and an adjacent sidewall.

* * * * *